US010011135B2

(12) United States Patent
Hatta et al.

(10) Patent No.: US 10,011,135 B2
(45) Date of Patent: Jul. 3, 2018

(54) RECORDING MEDIUM

(71) Applicant: CANON KABUSHIKI KAISHA, Tokyo (JP)

(72) Inventors: Naoya Hatta, Kawasaki (JP); Tetsuro Noguchi, Hachioji (JP); Kazuhiko Araki, Kawasaki (JP); Arika Tanaka, Yokohama (JP); Shoichi Takeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/482,531

(22) Filed: Apr. 7, 2017

(65) Prior Publication Data

US 2017/0291442 A1 Oct. 12, 2017

(30) Foreign Application Priority Data

Apr. 11, 2016 (JP) ..... 2016-079145
Sep. 23, 2016 (JP) ..... 2016-186136

(51) Int. Cl.

| | |
|---|---|
| ***B41M 5/50*** | (2006.01) |
| ***B41M 5/44*** | (2006.01) |
| ***B41J 2/415*** | (2006.01) |
| ***B41M 5/52*** | (2006.01) |

(52) U.S. Cl.

CPC ..... *B41M 5/443* (2013.01); *B41J 2/4155* (2013.01); *B41M 5/504* (2013.01); *B41M 5/506* (2013.01); *B41M 5/508* (2013.01); *B41M 5/5218* (2013.01); *B41M 2205/42* (2013.01)

(58) Field of Classification Search

CPC ..... B41M 5/50; B41M 5/506; B41M 5/508; B41M 5/5218

See application file for complete search history.

(56) References Cited

U.S. PATENT DOCUMENTS

| | | | | |
|---|---|---|---|---|
| 2006/0045998 | A1* | 3/2006 | Kitamura | B41M 5/506 428/32.24 |
| 2008/0182045 | A1 | 7/2008 | Silke | |
| 2014/0377482 | A1* | 12/2014 | Noguchi | B41M 5/502 428/32.35 |

FOREIGN PATENT DOCUMENTS

| | | | |
|---|---|---|---|
| EP | 2695740 | A2 | 2/2014 |
| EP | 2818329 | A1 | 12/2014 |
| JP | 61-10483 | A | 1/1986 |
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 2006103197 | A | 4/2006 |

* cited by examiner

*Primary Examiner* — Betelhem Shewareged
(74) *Attorney, Agent, or Firm* — Canon U.S.A. Inc., IP Division

(57) ABSTRACT

A recording medium includes a substrate and an ink-receiving layer as the top layer. The ink-receiving layer contains inorganic particles. The inorganic particles contain cationized colloidal silica, alumina hydrate, and fumed alumina. A content of the cationized colloidal silica is 5% or more by mass and 25% or less by mass based on a content of the inorganic particles. The mass ratio of the alumina hydrate to the fumed alumina (alumina hydrate content:fumed alumina content) is from 95:5 to 55:45.

13 Claims, No Drawings

RECORDING MEDIUM

BACKGROUND OF THE INVENTION

Field of the Invention

The present disclosure relates to a recording medium.

Description of the Related Art

A recording medium having an ink-receiving layer on a substrate is known to have high ink absorbency and scratch resistance. The ink-receiving layer contains alumina and colloidal silica.

Japanese Patent Laid-Open No. 2006-103197 discloses that a glossy layer containing colloidal silica and alumina secondary colloidal particles in a recording medium improves ink absorbency and scratch resistance.

SUMMARY OF THE INVENTION

The present disclosure provides a recording medium that maintains good conveyance characteristics, can suppress susceptibility to scratching, and has good ink absorbency.

A recording medium according to one aspect of the present disclosure includes a substrate and an ink-receiving layer as the top layer. The ink-receiving layer contains inorganic particles. The inorganic particles contain cationized colloidal silica, alumina hydrate, and fumed alumina. The content of cationized colloidal silica is 5% or more by mass and 25% or less by mass based on the content of the inorganic particles. The mass ratio of the alumina hydrate to the fumed alumina (alumina hydrate content:fumed alumina content) is from 95:5 to 55:45.

Further features of the present disclosure will become apparent from the following description of exemplary embodiments.

DESCRIPTION OF THE EMBODIMENTS

A study by the present inventors showed that a recording medium described in Japanese Patent Laid-Open No. 2006-103197 had insufficient scratch resistance and conveyance characteristics in an image-recording apparatus, such as a printer. A recording medium described in Japanese Patent Laid-Open No. 2006-103197 also had ink absorbency issues with potential for improvement. In order to provide a recording medium that maintains good conveyance characteristics, can suppress susceptibility to scratching, and has good ink absorbency, the present inventors have made extensive studies and arrived at the present disclosure.

The present disclosure will be described in detail with respect to the following suitable example embodiments.

First, the circumstances leading to the present disclosure will be described below.

As in a recording medium described in Japanese Patent Laid-Open No. 2006-103197, scratch resistance may be improved by colloidal silica contained in the top layer. However, a large amount of colloidal silica in the top layer sometimes significantly decreases the friction coefficient of the surface of the recording medium and prevents a recording medium from being conveyed to the print position in a printer. The present inventors found that a recording medium can maintain good conveyance characteristics when the content of colloidal silica in the top layer of the recording medium is 25% or less by mass based on the content of the inorganic particles in the top layer.

In an example embodiment, when the content of colloidal silica in the top layer of the recording medium is 5% or more by mass based on the content of the inorganic particles in the top layer, this imparts moderate lubricity to the surface of the recording medium and reduces the likelihood of scratching. Furthermore, in an example embodiment, the colloidal silica, alumina hydrate, and fumed alumina contents are adjusted to reduce susceptibility to scratching on the surface of the recording medium. Scratches on the surface of the recording medium are mainly caused when the recording medium is conveyed from its stored position to the print position in the printer. More specifically, scratches are caused by friction between the back surface of a first recording medium to be conveyed and the front surface of a second recording medium under the first recording medium.

The present inventors found that susceptibility to scratching depends greatly on the difference in glossiness between a scratched portion and a non-scratched portion on the recording medium. Thus, the glossiness of the entire surface of the recording medium is increased by mixing fine alumina hydrate and fumed alumina at a particular ratio (95:5 to 55:45 on a mass basis) together with colloidal silica. Fine alumina hydrate and fumed alumina can increase glossiness. The present inventors found that the increased glossiness of the surface of the recording medium can relatively reduce the difference in glossiness between a scratched portion and a non-scratched portion and consequently makes it difficult to see scratches or can suppress susceptibility to scratching.

Furthermore, in an example embodiment, a mixture of inorganic particles having different shapes, such as cationized colloidal silica, alumina hydrate, and fumed alumina, at a particular ratio also improves ink absorbency. Although a recording medium described in Japanese Patent Laid-Open No. 2006-103197 has improved ink absorbency, it was found that when a pigment ink is used the ink absorbency of the recording medium is still insufficient with respect to the uniform granularity of a pigment in an image formed on the recording medium. In an example embodiment, it was found that the ink absorbency can be increased to improve the uniform granularity of a pigment.

Although the reason for this is not completely clear, the present inventors believe the reason as described below.

As in a recording medium described in Japanese Patent Laid-Open No. 2006-103197, an ink-receiving layer containing colloidal silica and alumina has higher ink absorbency than an ink-receiving layer containing colloidal silica alone as inorganic particles. However, even in an ink-receiving layer containing colloidal silica and alumina, inorganic particles tend to be closely packed. Thus, an image formed on a recording medium has insufficiently uniform granularity of a pigment.

In contrast, in an example embodiment, an ink-receiving layer contains cationized colloidal silica, alumina hydrate, and fumed alumina at a particular ratio. Consequently, the size distribution of pores formed by these inorganic particles can be broadened without changing the peak top position of the pore size distribution. The present inventors assume that such pores are formed because the colloidal silica, alumina hydrate, and fumed alumina have different shapes and particle sizes, and the inorganic particles are prevented from being densely aggregated. Electron microscopic observation of the surface of the outermost ink-receiving layer of the recording medium showed that colloidal silica formed primary particles, and alumina hydrate and fumed alumina formed secondary particles. The present inventors assume that the state of these inorganic particles also contributes to the advantages of the present disclosure.

Thus, the present inventors believe that these constituents can synergistically produce their effects to achieve the advantages of the present disclosure.

[Recording Medium]

A recording medium according to an example embodiment includes a substrate and an ink-receiving layer as a top layer (hereinafter also referred to as "an outermost layer"). A recording medium according to an example embodiment can be an ink jet recording medium for use in an ink jet recording method.

The components of a recording medium according to an example embodiment will be described below.

<Substrate>

The substrate may be a base paper or may include a base paper and a resin layer, for example, a base paper covered with a resin. In an example embodiment, the substrate can include a base paper and a resin layer. The resin layer can be disposed on one or both sides of the base paper.

Base Paper

The base paper is composed mainly of wood pulp. If necessary, the base paper is composed of wood pulp and synthetic pulp, such as polypropylene pulp, or synthetic fibers, such as nylon or polyester fibers. Examples of the wood pulp include, but are not limited to, leaf bleached kraft pulp (LBKP), leaf bleached sulfite pulp (LBSP), needle bleached kraft pulp (NBKP), needle bleached sulfite pulp (NBSP), leaf dissolving pulp (LDP), needle dissolving pulp (NDP), leaf unbleached kraft pulp (LUKP), and needle unbleached kraft pulp (NUKP). These wood pulps may be used alone or in combination as required. The wood pulp can be LBKP, NBSP, LBSP, NDP, or LDP, which contains a large amount of short fiber component. The pulp can be chemical pulp (sulfate pulp or sulfite pulp) containing less impurities. The pulp can be bleached to increase the degree of whiteness. The base paper may contain a sizing agent, a white pigment, a paper strengthening agent, a fluorescent brightening agent, a water-retaining agent, a dispersant, and/or a softening agent.

In an example embodiment, the base paper preferably has a thickness of 50 μm or more and 250 μm or less, more preferably 50 μm or more and 210 μm or less, still more preferably 90 μm or more and 210 μm or less, most preferably 90 μm or more and 120 μm or less. In an example embodiment, the thickness of the base paper is calculated using the following method. First, a recording medium is cut with a microtome, and the cross section is observed with a scanning electron microscope. The thickness measurements at 100 or more points are averaged to determine the thickness of the base paper. The thickness of another layer in an example embodiment is also determined in the same manner.

In an example embodiment, the base paper preferably has a density of 0.6 g/cm$^3$ or more and 1.2 g/cm$^3$ or less, more preferably 0.7 g/cm$^3$ or more and 1.2 g/cm$^3$ or less, in accordance with Japanese Industrial. Standard (JIS) P 8118.

Resin Layer

In an example embodiment, when a base paper is covered with a resin, the resin layer covers at least part of a surface of the base paper. The coverage with a resin layer (the area of a surface of a base paper covered with the resin layer/the total area of the surface of the base paper) is preferably 70% or more, more preferably 90% or more, particularly preferably 100%, that is, the full surface of the base paper is particularly preferably covered with the resin layer.

In an example embodiment, the resin layer preferably has a thickness of 10 μm or more and 60 μm or less, more preferably 15 μm or more and 50 μm or less. The resin layer on each side of the base paper can have a thickness in the range described above.

The resin layer can be formed of a thermoplastic resin. Examples of the thermoplastic resin include, but are not limited to, acrylic resins, acrylic silicone resins, polyolefin resins, and styrene-butadiene copolymers. Among these, the thermoplastic resin may be a polyolefin resin. The term "polyolefin resin", as used herein, refers to a polymer of an olefin monomer. More specifically, the polyolefin resin may be a homopolymer or a copolymer of ethylene, propylene, and/or isobutylene. These polyolefin resins may be used alone or in combination as required. Among these, the polyolefin resin can be polyethylene. The polyethylene can be a low-density polyethylene (LDPE) or a high-density polyethylene (HDPE).

In an example embodiment, the resin layer may contain a white pigment, a fluorescent brightening agent, and/or an ultramarine blue pigment in order to control its opacity, degree of whiteness, and/or hue. In particular, the resin layer can contain a white pigment in order to improve its opacity. Examples of the white pigment include, but are not limited to, rutile and anatase titanium oxides. In an example embodiment, the white pigment content of the resin layer is preferably 3 g/m$^2$ or more and 30 g/m$^2$ or less. For resin layers disposed on both sides of the base paper, the total white pigment content of the two resin layers can be in the range described above. The white pigment content of the resin layer is preferably 25% or less by mass of the resin content. A white pigment content of more than 25% by mass may result in insufficient dispersion stability of the white pigment.

<Ink-Receiving Layer>

In an example embodiment, the ink-receiving layer may be a monolayer or a multilayer. The ink-receiving layer may be disposed on one or both sides of the substrate. The ink-receiving layer on one side of the substrate preferably has a thickness of 15 μm or more and 60 μm or less, more preferably 30 μm or more and 45 μm or less.

The materials of the ink-receiving layer will be described below.

Inorganic Particles

In an example embodiment, the ink-receiving layer contains inorganic particles. From the perspective of the color developability of an image, the inorganic particles preferably have an average primary particle size of 100 nm or less. In an example embodiment, the average primary particle size of inorganic particles is the number-average diameter of circles each having an area equal to the projected area of the corresponding primary particle of the inorganic particles in electron microscope observation. The measurement is performed at 100 or more points.

In an example embodiment, inorganic particles can be dispersed with a dispersant and can be used in a coating liquid for the ink-receiving layer. The dispersed inorganic particles preferably have an average secondary particle size of 0.1 nm or more and 500 nm or less, more preferably 1.0 nm or more and 300 nm or less, particularly preferably 10 nm or more and 250 nm or less. The average secondary particle size of dispersed inorganic particles can be measured by a dynamic light scattering method.

In an example embodiment, the inorganic particle content (% by mass) of the ink-receiving layer is preferably 50% or more by mass and 98% or less by mass, more preferably 70% or more by mass and. 96% or less by mass, of the total mass of the ink-receiving layer.

In an example embodiment, the ink-receiving layer contains alumina hydrate, fumed alumina, and colloidal silica as inorganic particles. Each of these will be described in detail below.

[Alumina Hydrate]

Alumina hydrate suitable for the ink-receiving layer according to an example embodiment is represented by the general formula (X):

$$Al_2O_{3-n}(OH)_{2n}\cdot mH_2O$$

(wherein n is 0, 1, 2, or 3, m is 0 or more and 10 or less, preferably 0 or more and 5 or less, and m and n are not 0 at the same time).

In many instances, mH2O means a detachable aqueous phase not involved in the formation of a crystal lattice, and therefore m is not necessarily an integer. When the alumina hydrate is heated, m may be 0.

In an example embodiment, the alumina hydrate can be produced using a known method. More specifically, the alumina hydrate can be produced by hydrolyzing an aluminum alkoxide, hydrolyzing sodium aluminate, or neutralizing an aqueous sodium aluminate solution with an aqueous aluminum sulfate or aluminum chloride solution.

It is known that alumina hydrate has a crystal structure of amorphous, gibbsite, or boehmite, depending on the heat treatment temperature. The crystal structure of alumina hydrate can be analyzed by an X-ray diffraction method. In an example embodiment, among these, boehmite or amorphous alumina hydrate can be used. Specific examples of alumina hydrate include, but are not limited to, alumina hydrates described in Japanese Patent Laid-Open Nos. 7-232473, 8-132731, 9-66664, and 9-76628 and commercial products Disperal HP14 and HP18 (manufactured by Sasol). These alumina hydrates may be used alone or in combination as required.

From the perspective of color developability, the alumina hydrate preferably has an average primary particle size of 5 nm or more and 20 nm or less. The alumina hydrate preferably has an average secondary particle size of 100 nm or more and 300 nm or less.

In an example embodiment, the alumina hydrate preferably has a BET specific surface area of 100 $m^2/g$ or more and 200 $m^2/g$ or less, more preferably 125 $m^2/g$ or more and 175 $m^2/g$ or less. The BET specific surface area is determined from the number of molecules or ions having a known size adsorbed on the surface of a sample. In an example embodiment, a gas to be adsorbed on the surface of a sample is nitrogen gas.

[Fumed Alumina]

Examples of fumed alumina for use in the ink-receiving layer according to an example embodiment include, but are not limited to, γ-alumina, α-alumina, δ-alumina, θ-alumina, and χ-alumina. Among these, γ-alumina can provide high image optical density and ink absorbency. Specific examples of the fumed alumina include, but are not limited to, Aeroxide Alu C, Alu 130, and Alu 65 (manufactured by Evonik Industries AG.).

In an example embodiment, the fumed alumina preferably has a BET specific surface area of 50 $m^2/g$ or more, more preferably 80 $m^2/g$ or more, and preferably 150 $m^2/g$ or less, more preferably 120 $m^2/g$ or less.

From the perspective of ink absorbency, the fumed alumina preferably has an average primary particle size of 5 nm or more, more preferably 11 nm or more. From the perspective of the color developability of an image, the fumed alumina preferably has an average primary particle size of 30 nm or less, more preferably 15 nm or less. From the perspective of ink absorbency and color developability, the fumed alumina preferably has an average secondary particle size of 150 nm or more and. 300 nm or less.

Alumina hydrate and fumed alumina for use in an example embodiment can be mixed in the form of aqueous dispersion with a coating liquid for an ink-receiving layer using an acid as a dispersant. The acid can be a monobasic acid, such as acetic acid, hydrochloric acid, nitric acid, sulfonic acid, or lactic acid. In an example embodiment, the amount of the acid is preferably 1.0% or more by mass and 2.0% or less by mass, more preferably 1.3% or more by mass and 1.6% or less by mass, of the total alumina hydrate and fumed alumina content.

[Colloidal. Silica]

In an example embodiment, colloidal silica is used to improve scratch resistance. Among various types of colloidal silica, spherical colloidal silica has high scratch resistance and improves the color developability of an image due to its high transparency. The term "spherical", as used herein, means that the ratio b/a of the average minimum diameter b to the average maximum diameter a of (50 or more and 100 or less) colloidal silica particles is 0.80 or more and 1.00 or less, preferably 0.90 or more and 1.00 or less, particularly preferably 0.95 or more and 1.00 or less, in scanning electron microscopic observation. The colloidal silica is cationized. The colloidal silica can be spherical cationic colloidal silica. More specifically, the spherical cationic colloidal silica may be PL-3 or PL-7 (manufactured. by Fuso Chemical Co., Ltd.), Snowtex AK, Snowtex AK-L, or MP-2040 (manufactured by Nissan Chemical Industries, Ltd.), or Cartacoat K303C (Clariant AG).

From the perspective of ink absorbency and the color developability of an image, the colloidal silica preferably has an average primary particle size of 30 nm or more and 100 nm or less.

[Another Type of Inorganic Particles]

As long as the features of the present disclosure are not impaired, a layer directly under the top layer can contain another type of inorganic particles. Examples of the other type of inorganic particles include, but are not limited to, silica, titanium dioxide, zeolite, kaolin, talc, hydrotalcite, zinc oxide, zinc hydroxide, aluminum silicate, calcium silicate, magnesium silicate, zirconium oxide, and zirconium hydroxide, as well as alumina hydrate and fumed alumina used in the top layer.

Binder

In an example embodiment, the ink-receiving layer can contain a binder. The term "binder", as used herein, refers to a material that can bind inorganic particles together to form a film.

In an example embodiment, the binder content of the ink-receiving layer is preferably 50% or less by mass, more preferably 30% or less by mass, of the inorganic particle content in terms of ink absorbency. The binder content of the ink-receiving layer is preferably 5.0% or more by mass, more preferably 8.0% or more by mass, of the inorganic particle content in terms of the binding of the ink-receiving layer.

Examples of the binder include, but are not limited to, starch derivatives, such as oxidized starch, etherified starch, and phosphorylated starch; cellulose derivatives, such as carboxymethylcellulose and hydroxyethylcellulose; casein, gelatin, soybean protein, poly (vinyl alcohol), and derivatives thereof; latexes of conjugated polymers, such as polyvinylpyrrolidone, maleic anhydride polymers, styrene-butadiene copolymers, and methyl methacrylate-butadiene copolymers; latexes of acrylic polymers, such as acrylate and methacrylate polymers; latexes of vinyl polymers, such as ethylene-vinyl acetate copolymers; latexes of functional-group-modified polymers, such as the polymers described above modified with a monomer having a functional group, such as a carboxy group; the polymers described above cationized with a cation group; the polymers described above having a surface cationized with a cation surfactant; the polymers described above having a surface on which poly(vinyl alcohol) is distributed by the polymerization of monomers constituting the polymers in the presence of cationic polyvinyl alcohol); the polymers described above having a surface on which cationic colloidal particles are distributed by the polymerization of monomers constituting the polymers in a suspension of the cationic colloidal particles; aqueous binders of thermosetting synthetic polymers, such as melamine polymers and urea polymers; polymers and copolymers of acrylates and methacrylates, such as poly(methyl methacrylate); and synthetic polymers, such as polyurethane polymers, unsaturated polyester polymers, vinyl chloride-vinyl acetate copolymers, poly(vinyl butyral), and alkyd polymers. These binders may be used alone or in combination as required.

Among these binders, poly(vinyl alcohol) and poly(vinyl alcohol) derivatives may be used. Examples of the poly (vinyl alcohol) derivatives include, but are not limited to, cation-modified poly(vinyl alcohol), anion-modified poly (vinyl alcohol), silanol-modified poly(vinyl alcohol), and poly(vinyl acetal). The cation-modified poly(vinyl alcohol) can be poly(vinyl alcohol) having a primary, secondary, or tertiary amino group or a quaternary ammonium group in its main chain or side chain, as described in Japanese Patent Laid-Open No. 61-10483.

Poly(vinyl alcohol) can be synthesized by saponification of poly(vinyl acetate). The degree of saponification of poly(vinyl alcohol) is preferably 80% or more and 100% or less by mole, more preferably 85% or more and 98% or less by mole. The degree of saponification is the rate of the number of moles of hydroxy groups produced by saponification of poly (vinyl acetate) to produce poly(vinyl alcohol). In an example embodiment, the degree of saponification is determined in accordance with JIS K 6726. The poly(vinyl alcohol) preferably has an average degree of polymerization of 2,000 or more, more preferably 2,000 or more and 5,000 or less. In an example embodiment, the average degree of polymerization is the viscosity-average degree of polymerization determined in accordance with JTS K 6726.

A coating liquid for an ink-receiving layer can be prepared using an aqueous poly(vinyl alcohol) or poly(vinyl alcohol) derivative solution. The solid content of the aqueous poly(vinyl alcohol) or poly(vinyl alcohol) derivative solution is preferably 3% or more by mass and 20% or less by mass.

Other Additive Agents

In an example embodiment, the ink-receiving layer may contain other additive agents. Specific examples of other additive agents include, but are not limited to, a cross-linker, a pH-adjuster, a thickener, a flow modifier, an antifoaming agent, a foam inhibitor, a surfactant, a release agent, a penetrant, a color pigment, a color dye, a fluorescent brightening agent, an ultraviolet absorber, an antioxidant, a preservative, a fungicide, a water resistance improver, a dye fixative, a curing agent, and a weatherproofer.

<Structure of Ink-Receiving Layer>

In an example embodiment, in addition to the ink-receiving layer serving as the top layer, another ink-receiving layer can be disposed between the top layer and a substrate. In other words, there may be two or more ink-receiving layers. In an example embodiment, the ink-receiving layer serving as the top layer is also referred to as a first ink-receiving layer, and an ink-receiving layer directly under the top layer is also referred to as a second ink-receiving layer.

The second ink-receiving layer can contain inorganic particles, a binder, and/or a cross-linker. The inorganic particles in the second ink-receiving layer may be the same as or different from the inorganic particles used in the first ink-receiving layer.

From the perspective of ink absorbency, the second ink-receiving layer preferably contains inorganic particles having a pore radius of 11 nm or more and 16 nm or less. The pore radius of inorganic particles can be determined by obtaining a desorption isotherm with an automatic specific surface area measuring apparatus Tristar 3000 (manufactured by Shimadzu Corporation) and calculating the average pore radius by the Barrett-Joyner-Halenda (BJH) method. The pore radius of inorganic particles in the exemplary embodiments described later was also determined by this method.

The second ink-receiving layer can contain silica as inorganic particles.

Silica for use in the second ink-receiving layer is broadly divided into wet silica and dry (fumed) silica in accordance with its production method. In one known wet process, a silicate is decomposed with an acid to form activated silica, and the activated silica is subjected to polymerization, coagulation, and sedimentation to produce hydrous silica. In one known dry process (gas-phase process), anhydrous silica is produced by high-temperature gas-phase hydrolysis of a silicon halide (a flame hydrolysis process) or by thermal reduction and vaporization of silica sand and coke using an arc in an electric furnace followed by air oxidization (an arc process). In an example embodiment, silica produced by a dry process (gas-phase process) (hereinafter also referred to as "fumed silica") can be used. Fumed silica has a particularly large specific surface area, particularly high ink absorbency, and a low refractive index. Thus, fumed silica can impart transparency and high color developability to the ink-receiving layer. Specific examples of fumed silica include, but are not limited to, Aerosil (manufactured by Nippon Aerosil Co., Ltd.) and Reolosil QS (manufactured by Tokuyama Corporation)

In an example embodiment, the fumed silica preferably has a BET specific surface area of 50 $m^2/g$ or more and 400 $m^2/g$ or less, more preferably 200 $m^2/g$ or more and 350 $m^2/g$ or less.

In an example embodiment, fumed silica can be dispersed with a dispersant and can be used in a coating liquid for the ink-receiving layer. The dispersed fumed silica preferably has a particle size (average secondary particle size) of 50 nm or more and 300 nm or less. The particle size of dispersed fumed silica can be measured by a dynamic light scattering method.

The second ink-receiving layer can contain fumed silica, and the content of fumed silica is preferably 40% or more by mass based on the content of inorganic particles in the second ink-receiving layer. When the fumed silica content of the second ink-receiving layer is in this range, an aggregate formed of alumina hydrate, fumed alumina, and fumed silica can exist between the first ink-receiving layer and the second ink-receiving layer. The aggregate has a larger pore size than an aggregate formed of one type of inorganic particles alone and can improve ink absorbency.

In an example embodiment, the first ink-receiving layer serving as the top layer in the ink-receiving layer composed of the first ink-receiving layer and the second ink-receiving layer preferably has a thickness of 0.5 μm or more and 2.0 μm or less, from the perspective of ink absorbency. The first ink-receiving layer more preferably has a thickness of 0.7 μm or more, still more preferably 1.0 μm or more. The first ink-receiving layer more preferably has a thickness of 1.8 μm or less. The second ink-receiving layer preferably has a thickness of 15 μm or more, from the perspective of ink absorbency. The second ink-receiving layer preferably has a thickness of 45 μm or less in order to make the formation of the ink-receiving layer easier.

In an example embodiment, the second ink-receiving layer can contain a binder.

The type of the binder may be the same as or different from the type of the binder used in the ink-receiving layer serving as the top layer (the first ink-receiving layer).

In an example embodiment, the second ink-receiving layer can further contain a cross-linker. Examples of the cross-linker include, but are not limited to, aldehyde compounds, melamine compounds, isocyanate compounds, zirconium compounds, amide compounds, aluminum compounds, boric acids, and borates. These cross-linkers may be used alone or in combination as required. In particular, when the binder is poly(vinyl alcohol) or a polyvinyl alcohol) derivative, among these cross-linkers, boric acid or a borate may be used.

Examples of boric acids include, but are not limited to, orthoboric acid ($H_3BO_3$), metaboric acid, and hypoboric acid. Borates can be water-soluble salts of these boric acids. Examples of such borates include, but are not limited to, alkali metal salts of boric acid, such as sodium borate and potassium borate, alkaline-earth metal salts of boric acid, such as magnesium borate and calcium borate, and ammonium salts of boric acid. Among these, orthoboric acid can improve the temporal stability of a coating liquid and reduce the occurrence of cracks.

The amount of cross-linker to be used depends on the manufacturing conditions. In an example embodiment, the cross-linker content of the ink-receiving layer is preferably 1.0% or more by mass and 50% or less by mass, more preferably 5% or more by mass and 40% or less by mass, of the binder content.

When the binder is poly(vinyl alcohol) and when the cross-linker is at least one selected from boric acids and borates, the total boric acid and borate content may be 5% or more by mass and 30% or less by mass of the poly(vinyl alcohol) content of the ink-receiving layer.

<Undercoat Layer>

In an example embodiment, in order to improve adhesion between the substrate and the ink-receiving layer, an undercoat layer may be disposed between the substrate and the ink-receiving layer. The undercoat layer can contain a water-soluble polyester polymer, gelatin, or poly(vinyl alcohol). The undercoat layer can have a thickness of 0.01 μm or more and 5 μm or less.

<Back Coat Layer>

In an example embodiment, a back coat layer may be disposed on a surface of the substrate opposite the ink-receiving layer in order to improve handleability, transportability, and scratch resistance during transport in continuous printing of a plurality of recording media. The back coat layer can contain a white pigment and a binder. The back coat layer preferably has a thickness such that the dry coating weight is 1 g/m$^2$ or more and 25 g/m$^2$ or less.

[Method for Manufacturing Recording Medium]

In an example embodiment, a method for manufacturing a recording medium is not particularly limited and can include a process of preparing a coating liquid for an ink-receiving layer and a process of applying the coating liquid for an ink-receiving layer to a substrate. A method for manufacturing a recording medium will be described below.

<Method for Manufacturing Substrate>

In an example embodiment, a method for manufacturing a base paper can be a common paper-making method. A paper-making apparatus, such as a fourdrinier paper machine, a cylinder machine, a drum paper machine, or a twin-wire former. In order to improve the surface smoothness of a base paper, heat and pressure may be applied to the base paper to perform surface treatment during or after the paper-making process. A specific surface treatment method may be calendering, such as machine calendering or super-calendering.

A method for forming a resin layer on a base paper or a method for coating a base paper with a resin may be a melt extrusion process, wet lamination, or dry lamination. In the melt extrusion process, one or both sides of a base paper can be coated with molten resin by extrusion coating. For example, a transported base paper and a resin from an extrusion die are pressed between a nip roller and a cooling roller to form a resin layer on the base paper (also referred to as an extrusion coating process). The extrusion coating process is widely employed. In the formation of a resin layer by the melt extrusion process, pretreatment may be performed to improve adhesion between a base paper and the resin layer. The pretreatment may be acid etching using a mixture of sulfuric acid and chromic acid, flame treatment using gas flame, ultraviolet irradiation treatment, corona discharge treatment, glow discharge treatment, or anchor coating treatment using an alkyl titanate. Among these, corona discharge treatment may be used. When the resin layer contains a white pigment, the base paper may be coated with a mixture of a resin and the white pigment.

The substrate thus manufactured can be wound around a core before the formation of the ink-receiving layer. The core preferably has a diameter of 50 mm or more and 300 mm or less. The polymer-coated substrate is preferably wound at a tension of 50 N/m or more and 800 N/m or less. The tension may be constant from the beginning to the end. In order to reduce pressure concentration in the beginning, the tension may be gradually reduced from the beginning to the end.

<Method for Forming Ink-Receiving Layer>

An ink-receiving layer of a recording medium according to an example embodiment can be formed on a substrate by the following method. First, a coating liquid for the ink-receiving layer is prepared. The coating liquid is applied to the substrate and is dried to produce a recording medium according to an example embodiment. The coating liquid can be applied with a curtain coater, an extrusion coater, or a slide hopper coater. The coating liquid may be heated during the application. The coating liquid may be dried using a hot-air dryer, such as a linear tunnel dryer, an arch dryer, an air loop dryer, or a sine-curve air float dryer, or an infrared, heating, or microwave dryer.

One aspect of the present disclosure provides a recording medium that maintains good conveyance characteristics, can suppress susceptibility to scratching, and has good ink absorbency.

EXAMPLES

The present disclosure will be further described with the following exemplary embodiments and comparative examples. Without departing from the gist of the present disclosure, the invention should not be limited to these exemplary embodiments. Unless otherwise specified, "part" in the exemplary embodiments is on a mass basis.

[Manufacture of Recording Medium]

<Manufacture of Substrate>

Water was added to a mixture of 80 parts of LBKP having a Canadian Standard freeness (CSF) of 450 mL, 20 parts of NBKP having a Canadian Standard freeness (CSF) of 480 mL, 0.60 parts of cationized starch, 10 parts of heavy calcium carbonate, 15 parts of light calcium carbonate, 0.10 parts of an alkyl ketene dimer, and 0.030 parts of cationic polyacrylamide such that the solid content was 3.0% by mass to prepare paper stock. The paper stock was then subjected to a fourdrinier paper machine and a three-stage wet press and was dried with a multi-cylinder dryer. The resulting paper was then impregnated with an aqueous solution of oxidized starch using a size press machine such that the solid content after drying was 1.0 g/m$^2$. After drying, the paper was subjected to machine calendering to produce a base paper 1. The base paper 1 had a basis weight of 170 g/m$^2$, a Stockigt sizing degree of 100 seconds, an air permeability of 50 seconds, a Bekk smoothness of 30 seconds, a Gurley stiffness of 11.0 mN, and a thickness of 100 μm. A resin composition composed of 70 parts of a low-density polyethylene, 20 parts of a high-density polyethylene, and 10 parts of titanium oxide was then applied to one side of the base paper 1 such that the dry coating amount was 25 g/m$^2$. This side of the base paper 1 is a front surface of the substrate. A low-density polyethylene was applied to the other side of the base paper 1 to complete a substrate 1.

<Preparation of Coating Liquid for Ink-Receiving Layer>

Preparation of Alumina Hydrate Dispersion Liquid 1

2.0 parts of acetic acid was added to 498 parts of ion-exchanged water. 100 parts of alumina hydrate (trade name: DISPERAL HP14, manufactured by Sasol) was added in small portions to the aqueous acetic acid while stirring with a homo mixer (manufactured by Tokushu Kika Kogyo Co., Ltd., trade name: T.K. Homomixer MARK II 2.5) at 3,000 rpm.

Stirring was continued for another 30 minutes after the completion of the addition, thus producing an alumina hydrate dispersion liquid 1 peptized with acetic acid.

The solid content of the alumina hydrate dispersion liquid 1 was 23% by mass. The alumina hydrate had an average secondary particle size of 140 nm.

Preparation of Alumina Hydrate Dispersion Liquid 2

1.5 parts of acetic acid was added to 498 parts of ion-exchanged water. 100 parts of alumina hydrate (trade name: DISPERAL HP18, manufactured by Sasol) was added in small portions to the aqueous acetic acid while stirring with a homo mixer (manufactured by Tokushu Kika Kogyo Co., Ltd., trade name: T.K. Homomixer MARK II 2.5) at 3,000 rpm.

Stirring was continued for another 30 minutes after the completion of the addition, thus producing an alumina hydrate dispersion liquid 2 peptized with acetic acid.

The solid content of the alumina hydrate dispersion liquid 2 was 23% by mass. The alumina hydrate had an average secondary particle size of 170 nm.

Preparation of Fumed Alumina Dispersion Liquid 1

2.0 parts of acetic acid was added to 498 parts of ion-exchanged water. 100 parts of fumed alumina (trade name: AEROXIDE Alu C, manufactured by Evonik Industries AG.) was added in small portions to the aqueous acetic acid while stirring with a homo mixer (manufactured by Tokushu Kika Kogyo Co., Ltd., trade name: T.K. Homomixer MARK II 2.5) at 3,000 rpm.

Stirring was continued for another 30 minutes after the completion of the addition, thus producing a fumed alumina dispersion liquid 1 peptized with acetic acid.

The solid content of the fumed alumina dispersion liquid 1 was 23% by mass. The fumed alumina had an average secondary particle size of 160 nm.

Preparation of Fumed Silica Dispersion Liquid 1

5 parts of a dimethyldiallylammonium chloride homopolymer Shallol DC902P (manufactured by Dai-ichi Kogyo Seiyaku Co., Ltd.) was added to 420 parts of ion-exchanged water in a suction type disperser Conti-TDS (manufactured by YSTRAL) Furthermore, 100 parts of fumed silica AEROSIL 300 (average primary particle size: 7 nm) (manufactured by Nippon Aerosil. Co., Ltd.) was added in small portions while stirring at the maximum rotational speed and was dispersed for 24 hours, thus producing a fumed silica dispersion liquid 1.

The solid content of the fumed silica dispersion liquid 1 was 20% by mass. The fumed silica had an average secondary particle size of 140 nm.

Preparation of Fumed Silica Dispersion Liquid 2

5 parts of a. dimethyldiallylammonium chloride homopolymer Shallol DC902P (manufactured by Dai-ichi Kogyo Seiyaku Co., Ltd.) was added to 420 parts of ion-exchanged water in a suction type disperser Conti-TDS (manufactured by YSTRAL) Furthermore, 100 parts of fumed silica AEROSIL 200 (average primary particle size: 12 nm) (manufactured by Nippon Aerosil Co., Ltd.) was added in small portions while stirring at the maximum rotational speed and was dispersed for 24 hours, thus producing a fumed silica dispersion liquid 2.

The solid content of the fumed silica dispersion liquid 2 was 20% by mass. The fumed silica had an average secondary particle size of 160 nm.

Colloidal Silica Dispersion Liquid

Colloidal silica dispersion liquids listed in Table 1 were prepared.

TABLE 1

Type of colloidal silica dispersion liquid

| Trade name | Manufacturer | Average primary particle size (nm) |
|---|---|---|
| ST-AK | Nissan Chemical | 15 |
| ST-XL | Industries, Ltd. | 50 |
| MP-2040 | | 200 |
| Cartacoat K303C | Clariant AG | 80 |

Preparation of Binder Solution

A polyvinyl alcohol) PVA 235 (manufactured by Kuraray Co., Ltd., viscosity-average degree of polymerization: 3,500, degree of saponification: 88% by mole) was dissolved in ion-exchanged water to produce a binder solution having a solid content of 8.0% by mass. Preparation of Coating Liquid 1-1 for Ink-Receiving Layer A colloidal silica dispersion liquid Cartacoat K303C, the alumina hydrate dispersion liquid 1, and the fumed alumina dispersion liquid 1 were mixed at a mass ratio of 10:81:9 on a solid basis to produce an inorganic particle dispersion liquid. The binder solution was added to the inorganic particle dispersion liquid such that the solid content of the binder solution was 9 parts per 100 parts of the inorganic particle solid content of the inorganic particle dispersion liquid, thus producing a liquid mixture. A cross-linker aqueous orthoboric acid (solid content: 5% by mass) was then added to the liquid mixture such that the solid content of the cross-linker was 1.0 part per 100 parts of the inorganic particle solid content of the liquid mixture. Ion-exchanged water was then added to the liquid mixture to produce a coating liquid for an ink-receiving layer 1-1. The total solids of the coating liquid 1-1 was 26% by mass.

Preparation of Coating Liquids for Ink-Receiving Layer 1-2 to 1-27 and 2-1 to 2-8

Coating liquids for an ink-receiving layer 1-2 to 1-27 and 2-1 to 2-8 were produced in the same manner as in the coating liquid for an ink-receiving layer 1-1 except that a colloidal silica dispersion liquid, an alumina hydrate dispersion liquid, a fumed alumina dispersion liquid, another dispersion liquid, a binder solution, and an aqueous orthoboric acid were mixed as listed in Tables 2 and 3.

TABLE 2

| Coating liquid | Colloidal silica dispersion liquid | Mass ratio | Alumina hydrate dispersion liquid | Mass ratio | Fumed alumina dispersion liquid | Mass ratio | Another dispersion liquid | Mass ratio | Mass ratio of alumina hydrate to fumed alumina | Binder (parts by mass) | Ortho-boric acid (parts by mass) |
|---|---|---|---|---|---|---|---|---|---|---|---|
| 1-1 | Cartacoat K303C | 10 | Alumina hydrate dispersion liquid 1 | 81 | Fumed alumina dispersion liquid 1 | 9 | — | 0 | 90:10 | 9 | 1.0 |
| 1-2 | Cartacoat K303C | 10 | Alumina hydrate dispersion liquid 1 | 54 | Fumed alumina dispersion liquid 1 | 36 | — | 0 | 60:40 | 9 | 1.0 |
| 1-3 | Cartacoat K303C | 25 | Alumina hydrate dispersion liquid 1 | 75 | — | 0 | — | 0 | 100:0 | 9 | 1.0 |
| 1-4 | Cartacoat K303C | 20 | Alumina hydrate dispersion liquid 1 | 64 | Fumed alumina dispersion liquid 1 | 16 | — | 0 | 80:20 | 9 | 1.0 |
| 1-5 | Cartacoat K303C | 30 | Alumina hydrate dispersion liquid 1 | 56 | Fumed alumina dispersion liquid 1 | 14 | — | 0 | 80:20 | 9 | 1.0 |
| 1-6 | Cartacoat K303C | 25 | Alumina hydrate dispersion liquid 1 | 60 | Fumed alumina dispersion liquid 1 | 15 | — | 0 | 80:20 | 9 | 1,0 |
| 1-7 | Cartacoat K303C | 20 | Alumina hydrate dispersion liquid 1 | 64 | Fumed alumina dispersion liquid 1 | 16 | — | 0 | 80:20 | 9 | 1.0 |
| 1-8 | Cartacoat K303C | 12 | Alumina hydrate dispersion liquid 1 | 70 | Fumed alumina dispersion liquid 1 | 18 | — | 0 | 80:20 | 9 | 1.0 |
| 1-9 | Cartacoat K303C | 10 | Alumina hydrate dispersion liquid 1 | 72 | Fumed alumina dispersion liquid 1 | 18 | — | 0 | 80:20 | 9 | 1.0 |
| 1-10 | Cartacoat K303C | 8 | Alumina hydrate dispersion liquid 1 | 74 | Fumed alumina dispersion liquid 1 | 18 | — | 0 | 80:20 | 9 | 1.0 |
| 1-11 | Cartacoat K303C | 5 | Alumina hydrate dispersion liquid 1 | 76 | Fumed alumina dispersion liquid 1 | 19 | — | 0 | 80:20 | 9 | 1.0 |
| 1-12 | — | 0 | Alumina hydrate dispersion liquid 1 | 80 | Fumed alumina dispersion liquid 1 | 20 | — | 0 | 80:20 | 9 | 1.0 |
| 1-13 | Cartacoat K303C | 20 | Alumina hydrate dispersion liquid 1 | 80 | — | 0 | — | 0 | 100:0 | 9 | 1.0 |
| 1-14 | Cartacoat K303C | 20 | Alumina hydrate dispersion liquid 1 | 76 | Fumed alumina dispersion liquid 1 | 4 | — | 0 | 95:5 | 9 | 1.0 |
| 1-15 | Cartacoat K303C | 20 | Alumina hydrate dispersion liquid 1 | 48 | Fumed alumina dispersion liquid 1 | 32 | — | 0 | 60:40 | 9 | 1.0 |
| 1-16 | Cartacoat K303C | 20 | Alumina hydrate dispersion liquid 1 | 44 | Fumed alumina dispersion liquid 1 | 36 | — | 0 | 55:45 | 9 | 1.0 |
| 1-17 | Cartacoat K303C | 20 | Alumina hydrate dispersion liquid 1 | 40 | Fumed alumina dispersion liquid 1 | 40 | — | 0 | 50:50 | 9 | 1,0 |
| 1-18 | Cartacoat K303C | 20 | Alumina hydrate dispersion liquid 1 | 72 | Fumed alumina dispersion liquid 1 | 8 | — | 0 | 90:10 | 9 | 1.0 |
| 1-19 | Cartacoat K303C | 5 | Alumina hydrate dispersion liquid 1 | 57 | Fumed alumina dispersion liquid 1 | 38 | — | 0 | 60:40 | 9 | 1.0 |
| 1-20 | Cartacoat K303C | 20 | Alumina hydrate dispersion liquid 2 | 64 | Fumed alumina dispersion liquid 1 | 16 | — | 0 | 80:20 | 9 | 1.0 |
| 1-21 | Cartacoat K303C | 20 | Alumina hydrate dispersion liquid 1 | 64 | — | 0 | Alumina hydrate dispersion liquid 2 | 16 | 100:0 | 9 | 1.0 |
| 1-22 | Cartacoat K303C | 20 | Alumina hydrate dispersion liquid 1 | 64 | — | 0 | Fumed silica dispersion liquid 1 | 16 | 100:0 | 9 | 1.0 |
| 1-23 | Cartacoat K303C | 20 | — | 0 | Fumed alumina dispersion liquid 1 | 80 | — | 0 | 0:100 | 9 | 1.0 |
| 1-24 | Cartacoat K303C | 10 | Alumina hydrate dispersion liquid 1 | 54 | Fumed alumina dispersion liquid 1 | 36 | — | 0 | 60:40 | 12 | 1.3 |
| 1-25 | MP-2040 | 20 | Alumina hydrate dispersion liquid 1 | 64 | Fumed alumina dispersion liquid 1 | 16 | — | 0 | 80:20 | 9 | 1.0 |
| 1-26 | ST-AK | 20 | Alumina hydrate dispersion liquid 1 | 64 | Fumed alumina dispersion liquid 1 | 16 | — | 0 | 80:20 | 9 | 1.0 |
| 1-27 | ST-XL | 20 | Alumina hydrate dispersion liquid 1 | 80 | — | 0 | — | 0 | 100:0 | 9 | 1.0 |

TABLE 3

| Coating liquid | Alumina hydrate dispersion liquid 1 (parts by mass) | Alumina hydrate dispersion liquid 2 (parts by mass) | Fumed alumina dispersion liquid 1 (parts by mass) | Fumed silica dispersion liquid 1 (parts by mass) | Fumed silica dispersion liquid 2 (parts by mass) | Binder (parts by mass) | Orthoboric acid (parts by mass) |
|---|---|---|---|---|---|---|---|
| 2-1 | | | | 100 | | 23 | 3.1 |
| 2-2 | 100 | | | | | 11 | 1.5 |
| 2-3 | | 100 | | | | 11 | 1.5 |
| 2-4 | | | | | 100 | 23 | 3.1 |
| 2-5 | | | 100 | | | 11 | 1.5 |
| 2-6 | 50 | | | 50 | | 17 | 2.3 |
| 2-7 | 60 | | | 40 | | 16 | 2.1 |
| 2-8 | 70 | | | 30 | | 15 | 2.0 |

<Manufacture of Recording Medium>

Manufacture of Recording Medium 1

The coating liquids for an ink-receiving layer 2-1 and 1-1 were applied to the substrate 1 in this order with a multilayer slide hopper type coating machine by a simultaneous multilayer coating method. The coating liquid for an ink-receiving layer 1-1 is a coating liquid for the top layer (for the first ink-receiving layer), and the coating liquid for an ink-receiving layer 2-1 is a coating liquid for a layer directly under the top layer (for the second ink-receiving layer). These coating liquids for an ink-receiving layer thus applied were then dried with hot air at 100° C. to produce a recording medium 1. The first ink-receiving layer serving as the top layer of the recording medium 1 had a thickness of 1 μm, and the second ink-receiving layer directly under the top layer had a thickness of 25 μm.

Manufacture of Recording Media 2 to 44

Recording media 2 to 44 were produced in the same manner as in the recording medium 1-1 except that the type of coating liquid for a top layer, and the type of coating liquid for a layer directly under the top layer, the pore radius of inorganic particles, the thickness of coating, and the concentration of the coating liquid were changed as listed in Table 4. In the recording medium 35, the coating liquid for a top layer was applied to the base paper 1.

TABLE 4

| | | Ink-receiving layer | | | | |
|---|---|---|---|---|---|---|
| | | Underlayer (second ink-receiving layer) | | | Top layer (first ink-receiving layer) | |
| Example/ Comparative example | Recording medium | Coating liquid | Pore radius (nm) | Thickness (μm) | Coating liquid | Thickness (μm) |
| Example 1 | Recording medium 1 | 2-1 | 12 | 25.0 | 1-1 | 1.0 |
| Example 2 | Recording medium 2 | 2-1 | 12 | 25.0 | 1-4 | 1.0 |
| Example 3 | Recording medium 3 | 2-1 | 12 | 25.0 | 1-4 | 0.5 |
| Example 4 | Recording medium 4 | 2-1 | 12 | 25.0 | 1-4 | 0.7 |
| Example 5 | Recording medium 5 | 2-1 | 12 | 25.0 | 1-4 | 1.0 |
| Example 6 | Recording medium 6 | 2-1 | 12 | 25.0 | 1-4 | 1.5 |
| Example 7 | Recording medium 7 | 2-1 | 12 | 25.0 | 1-4 | 1.8 |
| Example 8 | Recording medium 8 | 2-1 | 12 | 25.0 | 1-4 | 2.0 |
| Example 9 | Recording medium 9 | 2-1 | 12 | 20.0 | 1-4 | 1.0 |
| Example 10 | Recording medium 10 | 2-1 | 12 | 18.0 | 1-4 | 1.0 |
| Example 11 | Recording medium 11 | 2-1 | 12 | 25.0 | 1-6 | 1.0 |
| Example 12 | Recording medium 12 | 2-1 | 12 | 25.0 | 1-7 | 1.0 |
| Example 13 | Recording medium 13 | 2-1 | 12 | 25.0 | 1-8 | 1.0 |
| Example 14 | Recording medium 14 | 2-1 | 12 | 25.0 | 1-9 | 1.0 |
| Example 15 | Recording medium 15 | 2-1 | 12 | 25.0 | 1-10 | 1.0 |
| Example 16 | Recording medium 16 | 2-1 | 12 | 25.0 | 1-11 | 1.0 |
| Example 17 | Recording medium 17 | 2-1 | 12 | 25.0 | 1-14 | 1.0 |
| Example 18 | Recording medium 18 | 2-1 | 12 | 25.0 | 1-15 | 1.0 |
| Example 19 | Recording medium 19 | 2-1 | 12 | 25.0 | 1-16 | 1.0 |
| Example 20 | Recording medium 20 | 2-1 | 12 | 25.0 | 1-18 | 1.0 |
| Example 21 | Recording medium 21 | 2-1 | 12 | 25.0 | 1-18 | 1.4 |
| Example 22 | Recording medium 22 | 2-1 | 12 | 25.0 | 1-19 | 1.4 |
| Example 23 | Recording medium 23 | 2-1 | 12 | 25.0 | 1-20 | 1.0 |
| Example 24 | Recording medium 24 | 2-1 | 12 | 25.0 | 1-24 | 2.0 |
| Example 25 | Recording medium 25 | 2-1 | 12 | 25.0 | 1-25 | 1.0 |
| Example 26 | Recording medium 26 | 2-1 | 12 | 25.0 | 1-26 | 1.0 |
| Example 27 | Recording medium 27 | 2-2 | 9 | 25.0 | 1-4 | 1.0 |
| Example 28 | Recording medium 28 | 2-3 | 18 | 25.0 | 1-4 | 1.0 |
| Example 29 | Recording medium 29 | 2-5 | 14 | 25.0 | 1-4 | 1.0 |
| Example 30 | Recording medium 30 | 2-6 | 14 | 25.0 | 1-2 | 1.4 |
| Example 31 | Recording medium 31 | 2-7 | 16 | 25.0 | 1-4 | 1.0 |
| Example 32 | Recording medium 32 | 2-8 | 17 | 25.0 | 1-4 | 1.0 |
| Example 33 | Recording medium 33 | 2-8 | 17 | 20.0 | 1-4 | 1.0 |

TABLE 4-continued

| Example/ Comparative example | Recording medium | Ink-receiving layer: Underlayer (second ink-receiving layer) Coating liquid | Pore radius (nm) | Thickness (μm) | Top layer (first ink-receiving layer) Coating liquid | Thickness (μm) |
|---|---|---|---|---|---|---|
| Example 34 | Recording medium 34 | 2-1 | 12 | 25.0 | 1-4 | 1.0 |
| Example 35 | Recording medium 35 | — | — | — | 1-4 | 35.0 |
| Comparative example 1 | Recording medium 36 | 2-1 | 12 | 25.0 | 1-3 | 0.5 |
| Comparative example 2 | Recording medium 37 | 2-1 | 12 | 25.0 | 1-5 | 1.0 |
| Comparative example 3 | Recording medium 38 | 2-1 | 12 | 25.0 | 1-12 | 1.0 |
| Comparative example 4 | Recording medium 39 | 2-1 | 12 | 25.0 | 1-13 | 1.0 |
| Comparative example 5 | Recording medium 40 | 2-1 | 12 | 25.0 | 1-17 | 1.0 |
| Comparative example 6 | Recording medium 41 | 2-1 | 12 | 25.0 | 1-21 | 1.0 |
| Comparative example 7 | Recording medium 42 | 2-1 | 12 | 25.0 | 1-22 | 1.4 |
| Comparative example 8 | Recording medium 43 | 2-1 | 12 | 25.0 | 1-23 | 1.4 |
| Comparative example 9 | Recording medium 44 | 2-1 | 12 | 25.0 | 1-27 | 1.0 |

Example 1 to 35 and Comparative Examples 1 to 9

The recording media 1 to 44 were examined as described below. Electron microscopic observation of the surface of the outermost ink-receiving layer in the recording media according to Exemplary Embodiments 1 to 35 showed that colloidal silica formed primary particles, and alumina hydrate and fumed alumina formed secondary particles.

[Evaluation]

Evaluation of Conveyance Characteristics

Printing was performed on 100 sheets of plain paper SW-101 (manufactured by CANON KABUSHIKI KAISHA) with an ink jet recording apparatus Pixus iP2700 (manufactured by CANON KABUSHIKI KAISHA) in a low temperature and low humidity environment (15° C./10%RH). Next, the recording media were used, and three print commands were sent to the ink jet recording apparatus. Table 5 shows the evaluation results.

3: Printing was successful for all three times.

2: For one of the three times, the recording medium was not conveyed to the correct print position, and printing was not performed at the correct position on the recording medium.

1: For at least two of the three times, the recording medium was not conveyed to the correct print position, and printing was not performed at the correct position on the recording medium.

Evaluation of Scratching Susceptibility

Two recording media were prepared for each of the recording media. The two recording media were stacked in the ink jet recording apparatus PIXUS iP2700 (manufactured by CANON KABUSHIKI KAISHA). A black solid image was printed on the two recording media in the "photo paper Gold Glossy without color correction" mode. The printed surface of the second recording medium was visually inspected for scratches.

4: No scratches were observed on the printed surface.

3: Although a few scratches were observed on the printed surface only when the printed surface was illuminated at a particular angle, a scratched portion was scarcely recognized.

2: Although a few scratches were observed on the printed surface when the printed surface was illuminated at any angle, a scratched portion was scarcely recognized.

1: Scratches were observed on the printed surface when the printed surface was illuminated at any angle, and a scratched portion and a non-scratched portion were clearly distinguished.

Evaluation of Ink Absorbency

A gray image (each of KGB: 85) was printed with a pigment ink on the recording medium with an ink jet recording apparatus PIXUS Pro-10 (manufactured by CANON KABUSHTKT KATSHA). The printed surface was checked for the granularity of the pigment.

4: No granularity was observed.

3: A little negligible granularity was observed.

2: Granularity was observed but presented no practical problems.

1: Granularity was observed and significantly affected the image.

TABLE 5

| Example/ Comparative example | Recording medium | Elicitation of scratches | Conveyance characteristics | Ink absorbency |
|---|---|---|---|---|
| Example 1 | Recording medium 1 | 4 | 3 | 4 |
| Example 2 | Recording medium 2 | 4 | 3 | 4 |
| Example 3 | Recording medium 3 | 2 | 3 | 4 |
| Example 4 | Recording medium 4 | 3 | 3 | 4 |
| Example 5 | Recording medium 5 | 4 | 3 | 4 |
| Example 6 | Recording medium 6 | 4 | 3 | 4 |
| Example 7 | Recording medium 7 | 4 | 3 | 4 |
| Example 8 | Recording medium 8 | 4 | 3 | 3 |
| Example 9 | Recording medium 9 | 4 | 3 | 4 |
| Example 10 | Recording medium 10 | 3 | 3 | 4 |
| Example 11 | Recording medium 11 | 4 | 2 | 3 |
| Example 12 | Recording medium 12 | 4 | 3 | 4 |
| Example 13 | Recording medium 13 | 4 | 3 | 4 |
| Example 14 | Recording medium 14 | 4 | 3 | 4 |
| Example 15 | Recording medium 15 | 4 | 3 | 3 |
| Example 16 | Recording medium 16 | 2 | 3 | 2 |
| Example 17 | Recording medium 17 | 4 | 3 | 2 |
| Example 18 | Recording medium 18 | 4 | 3 | 4 |
| Example 19 | Recording medium 19 | 2 | 3 | 4 |
| Example 20 | Recording medium 20 | 4 | 3 | 4 |
| Example 21 | Recording medium 21 | 4 | 3 | 4 |
| Example 22 | Recording medium 22 | 4 | 3 | 4 |
| Example 23 | Recording medium 23 | 4 | 3 | 4 |
| Example 24 | Recording medium 24 | 4 | 3 | 3 |
| Example 25 | Recording medium 25 | 4 | 3 | 4 |
| Example 26 | Recording medium 26 | 4 | 3 | 3 |
| Example 27 | Recording medium 27 | 3 | 3 | 2 |
| Example 28 | Recording medium 28 | 3 | 3 | 3 |
| Example 29 | Recording medium 29 | 3 | 3 | 2 |
| Example 30 | Recording medium 30 | 4 | 3 | 4 |
| Example 31 | Recording medium 31 | 4 | 3 | 4 |
| Example 32 | Recording medium 32 | 3 | 3 | 3 |
| Example 33 | Recording medium 33 | 3 | 3 | 3 |
| Example 34 | Recording medium 34 | 2 | 3 | 3 |
| Example 35 | Recording medium 35 | 3 | 3 | 2 |

TABLE 5-continued

| Example/ Comparative example | Recording medium | Elicitation of scratches | Conveyance characteristics | Ink absorbency |
|---|---|---|---|---|
| Comparative example 1 | Recording medium 36 | 4 | 3 | 1 |
| Comparative example 2 | Recording medium 37 | 4 | 1 | 2 |
| Comparative example 3 | Recording medium 38 | 1 | 3 | 1 |
| Comparative example 4 | Recording medium 39 | 4 | 3 | 1 |
| Comparative example 5 | Recording medium 40 | 1 | 3 | 4 |
| Comparative example 6 | Recording medium 41 | 4 | 3 | 1 |
| Comparative example 7 | Recording medium 42 | 1 | 3 | 2 |
| Comparative example 8 | Recording medium 43 | 1 | 3 | 4 |
| Comparative example 9 | Recording medium 44 | 1 | 3 | 4 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-079145 filed Apr. 11, 2016 and No. 2016-186136 filed Sep. 23, 2016, which are hereby incorporated by reference herein in their entirety.

What is claimed is:

1. A recording medium, comprising:

a substrate; and an ink-receiving layer as a top layer, wherein the ink-receiving layer contains inorganic particles, wherein the inorganic particles contain cationized colloidal silica, alumina hydrate, and fumed alumina, wherein a content of the cationized colloidal silica is 5% or more by mass and 25% or less by mass based on a content of the inorganic particles, and wherein a mass ratio of the alumina hydrate to the fumed alumina (alumina hydrate content:fumed alumina content) is from 95:5 to 55:45.

2. The recording medium according to claim 1, wherein the content of the inorganic particles in the ink-receiving layer is 50% or more by mass and 98% or less by mass based on the total mass of the ink-receiving layer.

3. The recording medium according to claim 1, wherein the ink-receiving layer further contains a binder.

4. The recording medium according to claim 1, wherein the ink-receiving layer as the top layer is a first ink-receiving layer, and the recording medium further has a second ink-receiving layer directly under the first ink-receiving layer.

5. The recording medium according to claim 4, wherein the first ink-receiving layer has a thickness of 0.5 μm or more and 2.0 μm or less.

6. The recording medium according to claim 4, wherein the second ink-receiving layer contains inorganic particles having a pore radius of 11 nm or more and 16 nm or less.

7. The recording medium according to claim 4, wherein the second ink-receiving layer contains fumed silica, and a content of the fumed silica is 40% or more by mass based on a content of inorganic particles in the second ink-receiving layer.

8. The recording medium according to claim 4, wherein the second ink-receiving layer has a thickness of 15 μm or more and 45 μm or less.

9. The recording medium according to claim 1, wherein the mass ratio of the alumina hydrate to the fumed alumina is from 90:10 to 60:40.

10. The recording medium according to claim 1, wherein the content of the cationized colloidal silica is 8% or more by mass and 20% or less by mass based on the content of the inorganic particles.

11. The recording medium according to claim 1, wherein a content of the alumina hydrate is 44% or more by mass and 81% or less by mass based on the content of the inorganic particles.

12. The recording medium according to claim 1, wherein a content of the fumed alumina is 4% or more by mass and 38% or less by mass based on the content of the inorganic particles.

13. The recording medium according to claim 1, wherein a total content of the alumina hydrate and the fumed alumina is 75% or more by mass and 95% or less by mass based on the content of the inorganic particles.

* * * * *